US009221257B2

(12) United States Patent
Moriya et al.

(10) Patent No.: US 9,221,257 B2
(45) Date of Patent: Dec. 29, 2015

(54) LIQUID EJECTION HEAD AND RECORDING APPARATUS

(71) Applicant: CANON KABUSHIKI KAISHA, Tokyo (JP)

(72) Inventors: Takatsugu Moriya, Tokyo (JP); Kazuhiro Yamada, Yokohama (JP); Zentaro Tamenaga, Sagamihara (JP); Takuto Moriguchi, Kamakura (JP); Shingo Okushima, Kawasaki (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/698,124

(22) Filed: Apr. 28, 2015

(65) Prior Publication Data

US 2015/0328890 A1 Nov. 19, 2015

(30) Foreign Application Priority Data

May 13, 2014 (JP) ..... 2014-099417
Feb. 23, 2015 (JP) ..... 2015-032690

(51) Int. Cl.
*B41J 2/14* (2006.01)
*B41J 2/16* (2006.01)

(52) U.S. Cl.
CPC ..... *B41J 2/1433* (2013.01)

(58) Field of Classification Search
CPC ..... B41J 2/1433; B41J 2/155
See application file for complete search history.

(56) References Cited

U.S. PATENT DOCUMENTS

| | | | | |
|---|---|---|---|---|
| 7,686,423 | B2 * | 3/2010 | Sato et al. | 347/50 |
| 7,789,488 | B2 * | 9/2010 | Mori | 347/50 |
| 8,157,356 | B2 | 4/2012 | Yamamoto et al. | |
| 2007/0132815 | A1 | 6/2007 | Sakaida | |
| 2013/0083120 | A1 | 4/2013 | Choy | |
| 2015/0029265 | A1 | 1/2015 | Iwanaga et al. | |
| 2015/0085018 | A1 | 3/2015 | Yamada et al. | |
| 2015/0124025 | A1 | 5/2015 | Yamada et al. | |
| 2015/0130875 | A1 | 5/2015 | Tamenaga et al. | |

FOREIGN PATENT DOCUMENTS

JP 4539549 B2 9/2010

OTHER PUBLICATIONS

U.S. Appl. No. 14/696,847, filed Mar. 27, 2015, Zentaro Tamenago.

* cited by examiner

*Primary Examiner* — Juanita D Jackson
(74) *Attorney, Agent, or Firm* — Fitzpatrick, Cella, Harper & Scinto

(57) ABSTRACT

Provided is a liquid ejection head including a support member; a liquid chamber member being fixed onto the support member through an adhesive and including a liquid chamber configured to store liquid therein; and a recording element substrate being fixed onto the liquid chamber member through the adhesive and including an ejection orifice from which the liquid is ejected and a recording element configured to generate ejection energy. The support member and the liquid chamber member have different coefficients of linear expansion. The surface of the liquid chamber member on the recording element substrate side includes a first region on which the adhesive for fixing the recording element substrate is applied; and a second region being a region other than the first region. The first region has a parallelogram shape, and the second region has a rectangular shape.

20 Claims, 7 Drawing Sheets

LIQUID EJECTION HEAD AND RECORDING APPARATUS

BACKGROUND OF THE INVENTION

1. Field of the Invention

The present invention relates to a liquid ejection head configured to eject liquid, and a recording apparatus including the liquid ejection head.

2. Description of the Related Art

Among liquid ejection heads, for example, an ink-jet recording head for use in an ink-jet recording apparatus includes a recording element substrate having ink ejection orifices formed therein so as to allow ink droplets to be ejected therefrom, and a support member configured to support the recording element substrate. On the recording element substrate, recording elements for generating ejection energy are arranged so as to correspond to the ink ejection orifices. As the recording elements, heating resistance elements such as heaters are employed. In addition, in the support member, an ink supply path from which ink is supplied to the recording element substrate is formed.

In the above-mentioned ink-jet recording head, as the number of the recording elements arranged on the recording element substrate is increased and a recording width capable of performing recording on a recording medium is increased, recording can be performed at higher speed. Accordingly, the number of the recording elements and the recording width are being increased. In recent years, in order to realize recording at higher speed with higher image quality, attention is paid on a liquid ejection head in which a plurality of recording element substrates are arranged in series over a length equal to or larger than a width of the recording medium (hereinafter referred to as a line head).

As a configuration of the line head, there is a configuration in which a plurality of the ink-jet recording heads are connected together or a configuration in which the support member is elongated and a plurality of the recording element substrates are arrayed on the support member. In the line head having the latter configuration, when the recording element substrates each having a rectangular shape in plan view are arranged in series so that rows of the ink ejection orifices, from which the same kind of ink is ejected, are arranged in a straight line across all of the recording element substrates, a plurality of boundaries are formed between the adjacent recording element substrates. As a result, due to an influence of a manufacture error of each of the recording element substrates, it is difficult to match the interval between the two ink ejection orifices adjacent to each other with each of the boundaries therebetween to an interval between the ink ejection orifices formed in each of the recording element substrates. Accordingly, intervals between ink droplets which are ejected onto a recording medium from the rows of the ejection orifices for the same kind of ink of all of the recording element substrates may not be equalized. In order to solve this problem, hitherto, there has been proposed a line head having a configuration in which the recording element substrates each having a rectangular shape are arranged in a zigzag pattern, and also arranged so that positions of longitudinal end portions of the respective recording element substrates overlap each other when viewed from a direction perpendicular to the arranging direction of the recording element substrates (this direction corresponds to a conveying direction of the recording medium, and is hereinafter referred to as a "main scanning direction".). In the configuration employing zigzag arrangement, as compared to the above-mentioned example, it is easy to equalize the intervals between the ink droplets, which are ejected onto the recording medium from the rows of the ejection orifices for the same kind of ink of all the recording element substrates, when viewed from the main scanning direction. Thus, it is possible to prevent degradation of image quality at the positions where the longitudinal end portions of the respective recording element substrates overlap each other.

In addition, as a configuration made to achieve downsizing as compared to the above-mentioned line head employing the zigzag arrangement, the following configuration (Japanese Patent No. 4539549) has been proposed. Specifically, the outer shape of the recording element substrate exhibits a parallelogram in plan view. Further, when a plurality of the recording element substrates are arrayed on the support member having a long length, the recording element substrates are placed so that a pair of opposing sides of the recording element substrates are inclined with respect to the arraying direction, and the inclined sides of the respective recording element substrates are arranged in intimate contact with each other. In particular, in this configuration, under a state in which the inclined sides of the respective recording element substrates are arranged in intimate contact with each other, the recording element substrates are placed from one longitudinal end side to another longitudinal end side of the support member so as to be staggered in the main scanning direction. This configuration can equalize the intervals between the ink droplets, which are ejected onto a recording medium from the rows of the ejection orifices for the same kind of ink of all the recording element substrates, when viewed from the main scanning direction. In this configuration, unlike the above-mentioned line head employing the zigzag arrangement, it is unnecessary to stagger the adjacent recording element substrates in the main scanning direction by a distance or more corresponding to the width of the recording element substrate in the main scanning direction. Accordingly, this configuration can be downsized as compared to the line head employing the zigzag arrangement.

Further, in order to achieve easy manufacture in addition to the downsizing of the line head, there has been proposed a configuration in which a recording element substrate having a rectangular shape in plan view is mounted on a carrier so as to form a recording element module, and the recording element modules are arrayed in series on a support member (US 2013/0083120).

When manufacturing the line head, recording element members, such as the recording element module and the recording element substrate, are fixed by bonding on the support member using an adhesive. In a case where a thermally curable adhesive is employed as the adhesive, the recording element members are arranged on the support member through the thermally curable adhesive, and then a heating process of heating the entire line head so as to cure the adhesive is performed. In general, different materials are used for the recording element members and the support member, and the recording element members and the support member have different coefficients of linear expansion. Accordingly, when the support member and the recording element members, which are fixed by bonding to each other in the heating process, return from a high-temperature state caused by the heating process to a room-temperature state, a difference in thermal shrinkage amount occurs between the support member and the recording element members. Due to the difference in thermal shrinkage amount, stress acts on the cured thermally curable adhesive between the support member and the recording element members (hereinafter referred to as an adhesion region).

Here, when defining an XY orthogonal coordinate system on a surface of the support member configured to support the recording element members, the above-mentioned stress can be represented by forces generated in opposite directions with a center line of the adhesion region (line passing through a center of gravity of the adhesion region) therebetween in each of the X-axis direction and the Y-axis direction of the coordinate system. The forces generated in the opposite directions with the center line of the adhesion region therebetween may not act symmetrically with respect to the center line of the adhesion region depending on the shape of the adhesion region. In this case, when the temperature of the line head is returned to room temperature after the line head is subjected to the heating process as described above, the adhesion region is turned. For example, as illustrated in FIG. 1C1, in a case where a recording element substrate 4 having a parallelogram shape in plan view is fixed on a support member 2 through a liquid chamber member 3, when the outer shape of the liquid chamber member 3 exhibits a parallelogram similarly to that of the recording element substrate 4, an adhesion region between the support member 2 and the liquid chamber member 3 also exhibits substantially a parallelogram. In a case where the adhesion region exhibits a parallelogram in this manner, as illustrated in FIG. 1C1, forces generated in opposite directions with a center line Lx of the liquid chamber member 3 therebetween do not act symmetrically with respect to the center line Lx. In addition, forces generated in opposite directions with a center line Ly of the liquid chamber member 3 therebetween do not also act symmetrically with respect to the center line Ly. Accordingly, on two sides of the liquid chamber member 3 opposing to each other in each of the X-axis direction and the Y-axis direction, there are portions in which the forces do not cancel each other out (see the solid arrows of FIG. 1C1), with the result that turning of the liquid chamber member 3 may be caused.

As described above, when the turning of the adhesion region is caused, the position of the recording element substrate fixed on the adhesion region is shifted in association with the turning. Therefore, positions of the ink ejection orifices of the recording element substrate are displaced from desired positions, and positions at which ink droplets ejected from the ink ejection orifices land the recording medium (recording positions) are also shifted from desired positions. As a result, quality of the image recorded with the ink is degraded.

SUMMARY OF THE INVENTION

In order to attain the above-mentioned object, according to an embodiment of the present invention, there is provided a liquid ejection head, including:

a support member;

a liquid chamber member being fixed onto the support member through an adhesive and including a liquid chamber configured to store liquid therein; and a recording element substrate being fixed onto the liquid chamber member through the adhesive and including an ejection orifice from which the liquid is ejected and a recording element configured to generate ejection energy, in which the support member and the liquid chamber member have different coefficients of linear expansion, in which a surface of the liquid chamber member on the recording element substrate side includes:

a first region on which the adhesive for fixing the recording element substrate is applied; and a second region being a region other than the first region, and in which the first region has a parallelogram shape, and the second region has a rectangular shape.

According to another embodiment of the present invention, there is provided a liquid ejection head, including:

a support member;

a liquid chamber member being mounted on the support member through an adhesive and including a liquid chamber formed therein; and a recording element substrate being mounted on the liquid chamber member and including an ejection orifice from which liquid is ejected and a recording element configured to generate ejection energy, wherein the support member has a coefficient of linear expansion different from a coefficient of linear expansion of the liquid chamber member, wherein the liquid chamber member includes:

a recording element substrate mounting portion on which the recording element substrate is mounted; and a non-mounting portion on which no recording element substrate is mounted, the non-mounting portion being formed integrally with the recording element substrate mounting portion, wherein a plan view shape of the recording element substrate mounting portion has a pair of opposing and parallel first sides and a pair of opposing second sides not perpendicular to the pair of first sides, wherein a plan view shape of the non-mounting portion exhibits a polygonal shape sharing one of the pair of the first sides and has a pair of third sides respectively connecting with the pair of second sides, wherein, in a case where a first angle formed by one of the pair of first sides and one of the pair of second sides is larger than 90 degrees, a third angle that is the sum of the first angle and a second angle formed by the one of the pair of first sides and one of the pair of third sides is larger than 180 degrees, and wherein, in a case where the first angle is smaller than 90 degrees, the third angle is smaller than 180 degrees.

According to still another embodiment of the present invention, there is provided a liquid ejection head, including:

a support member;

a liquid chamber member being fixed onto the support member via an adhesive and including a liquid chamber configured to store liquid therein; and a recording element substrate being fixed onto the liquid chamber member via the adhesive and including an ejection orifice from which the liquid is ejected and a recording element configured to generate ejection energy, wherein the support member and the liquid chamber member have different coefficients of linear expansion, wherein a surface of the liquid chamber member on the recording element substrate side includes:

a first region on which the adhesive for fixing the recording element substrate is applied; and a second region being a region other than the first region, and wherein the first region has a parallelogram shape, and the second region has a rectangular shape.

Further features of the present invention will become apparent from the following description of exemplary embodiments with reference to the attached drawings.

BRIEF DESCRIPTION OF THE DRAWINGS

FIGS. 1A, 1B, 1C1, 1C2 and 1D are views illustrating a first embodiment of the present invention.

DESCRIPTION OF THE EMBODIMENTS

Figure 1A:
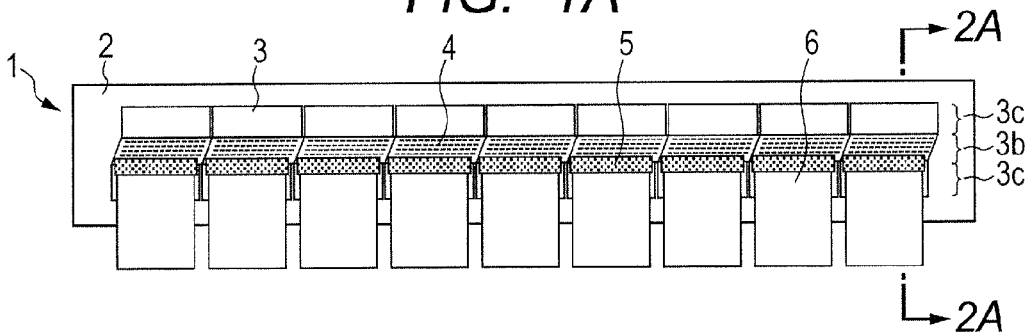

Preferred embodiments of the present invention will now be described in detail in accordance with the accompanying drawings.

A liquid ejection head for use in an embodiment of the present invention is briefly described referring to a typical ink-jet recording apparatus by way of examples.

In the specification of the present invention, the term "recording" not only encompasses a case where meaningful information such as letters and figures is formed, but also widely encompasses a case where an image, a design, a pattern, or the like is formed on a recording medium, or a case where processing of the medium is performed. The information obtained by recording may be meaningful or unmeaningful, and recording is not always required to actualize the information so as to enable humans to visually perceive the information.

Further, the term "recording medium" encompasses not only paper used in the typical recording apparatus, but also objects capable of receiving ink, such as cloth, plastic films, metal plates, glass, ceramic, wood, and leather.

Still further, the term "ink" should be widely construed similarly to the above-mentioned definition of the term "recording", and encompasses liquids usable for formation of an image, a design, a pattern, etc., processing of the recording medium, or treatment of ink through application on a recording medium. Therefore, the term "ink" encompasses any kinds of liquid usable for recording.

In the specification of the present invention, a line head having the following configuration is adopted. Specifically, using a recording element substrate having an outer shape exhibiting a parallelogram in plan view as described in Japanese Patent No. 4539549, a recording element module as described in US 2013/0083120 is produced, and a plurality of the recording element modules are mounted on a support member in line. In this case, the "recording element module" is formed of a unit obtained by mounting a recording element substrate 4 and an electric wiring member 6 such as a flexible printed circuit (FPC) or a tape automated bonding (TAB) tape on a liquid chamber member 3, electrically connecting an electric connection terminal of the recording element substrate 4 and the electric wiring member 6 to each other through a wire, a lead, or the like, and protecting the electric connection portion by a sealing member 5 (see FIGS. 1A to 1D, FIGS. 2A to 2C, etc.). In this case, the liquid chamber member 3 supports the recording element substrate 4, and includes a liquid chamber 3*a* storing therein liquid to be supplied to the recording element substrate 4.

When manufacturing the line head, the liquid chamber member 3 positioned at a lowermost portion of the recording element module is fixed by bonding on the support member 2 through an adhesive. A thermally curable adhesive is employed as the adhesive. In this case, there is performed a heating process of heating the entire line head so as to cure the adhesive. The line head includes the recording element modules arranged on the support member 2 through the adhesive.

In a case where the liquid chamber member 3 and the support member 2 have different coefficients of linear expansion, when the support member 2 and the liquid chamber member 3, which are fixed by bonding to each other in the heating process, return from a high-temperature state caused by the heating process to a room-temperature state, a difference in thermal shrinkage amount occurs between the support member 2 and the liquid chamber member 3. Due to the difference in thermal shrinkage amount, stress acts on an adhesion region between the support member 2 and the liquid chamber member 3. (cured thermally curable adhesive) Here, when defining an XY orthogonal coordinate system on a surface of the support member 2 configured to support the liquid chamber members 3, the above-mentioned stress can be represented by forces generated in opposite directions with a center line of the adhesion region (line passing through a center of gravity) therebetween in each of an X-axis direction and a Y-axis direction of the coordinate system. The forces are increased toward a peripheral edge portion of the adhesion region distant from the center line. Note that, the X-axis direction corresponds to a direction of arraying the plurality of recording element substrates 4 in series.

If a liquid chamber member having a rectangular shape in plan view is fixed by bonding on a support member having a rectangular shape in plan view as disclosed in US 2013/0083120, an adhesion region between the support member and the liquid chamber member also exhibits a rectangular shape in plan view. In this case, in the X-axis direction and the Y-axis direction of the adhesion region, the above-mentioned forces generated in opposite directions with the center line of the adhesion region therebetween are symmetrical with respect to the center line. Accordingly, the adhesion region merely deforms in a direction perpendicular to a surface of the recording element substrate in which ejection orifices are formed (hereinafter, referred to as an ejection orifice surface).

On the other hand, in a case where the liquid chamber member 3, which is to be fixed by bonding on the support member 2 having a rectangular shape in plan view, is formed to have a parallelogram outer shape in plan view, the adhesion region between the support member 2 and the liquid chamber member 3 exhibits substantially a parallelogram in plan view. In this case, as described above, the forces generating in opposite directions on the both sides of the center line of the adhesion region (line passing through the center of gravity of the adhesion region) do not act symmetrically with respect to the center line. Thus, on two sides of the adhesion region opposing to each other in each of the X-axis direction and the Y-axis direction, there are portions in which the forces do not cancel each other out. As a result, in addition to the above-mentioned deformation of the adhesion region in the direction perpendicular to the ejection orifice surface, turning of the liquid chamber member 3 is caused (see FIG. 1C1).

When the turning of the liquid chamber member 3 is caused, the recording element substrate 4 on the liquid chamber member 3 is also shifted in association with the turning. When the recording element substrate 4 is shifted, the position of an ink ejection orifice 4*a* of the recording element substrate 4 is shifted from a desired position, and the position at which ink droplets ejected from the ink ejection orifice 4*a* impact on a recording medium (recording positions) is also shifted from a desired position. As a result, there arises a problem of degradation of quality of the image recorded with the ink.

First Embodiment

With reference to FIGS. 1A to 1D and FIG. 3, description is made of this embodiment adopting a configuration for solving the above-mentioned problem.

Figure 1B:
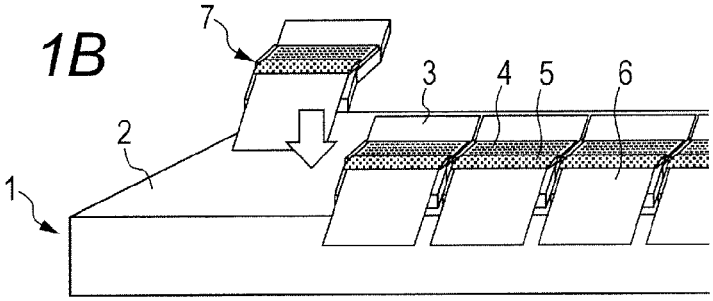
Figure 1B:
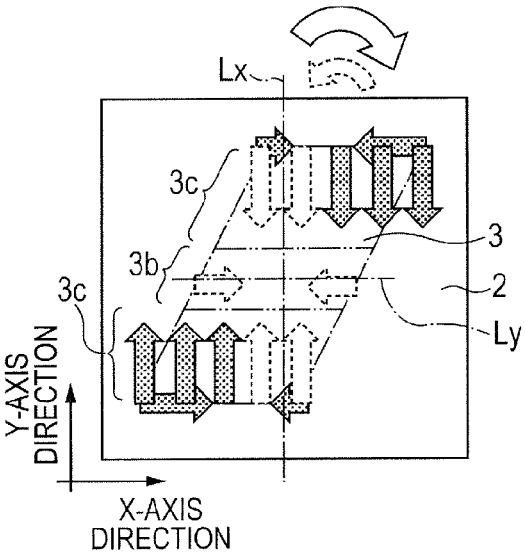
Figure 1B:
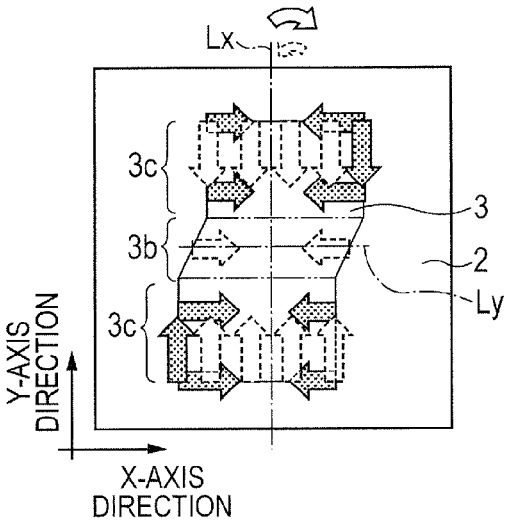

FIG. 1A is a schematic view illustrating a liquid ejection head 1 according to the first embodiment. The liquid ejection head 1 according to the first embodiment has a configuration in which a plurality of recording element modules 7, each of which is a unit comprised of a liquid chamber member 3, a recording element substrate 4, a sealing member 5, and an electric wiring member 6, are arranged on a support member 2 in series (in line). A recording element substrate mounting portion 3*b* of the liquid chamber member 3, on which the recording element substrate 4 is mounted, has a parallelogram outer shape of which is substantially the same as the outer shape of the recording element substrate 4 in plan view. When the plurality of recording element modules 7 are arrayed on the support member 2 having a rectangular shape with a long length in plan view, the recording element substrates 4 are arranged so that a pair of opposing sides of the recording element substrates 4 are inclined with respect to the arraying direction, and the inclined sides of the respective recording element substrates 4 are close to each other. Note that, the support member 2 and the liquid chamber member 3 are made of materials having different coefficients of linear expansion. FIG. 1B is a schematic view illustrating a configuration in which the recording element modules 7 are arranged on the support member 2. The recording element substrate 4 and the electric wiring member 6 are electrically connected to each other through a wire, a lead, or the like (not shown).

Figure 2A:
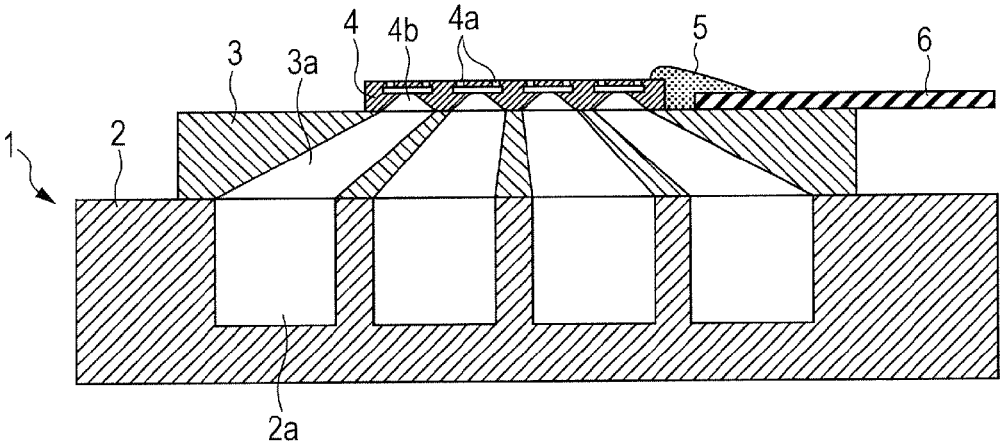
FIGS. 2A, 2B and 2C are cross-sectional views taken along the line 2A-2A of FIG. 1A, for illustrating configurations of various ink flow paths.
Figure 2B:
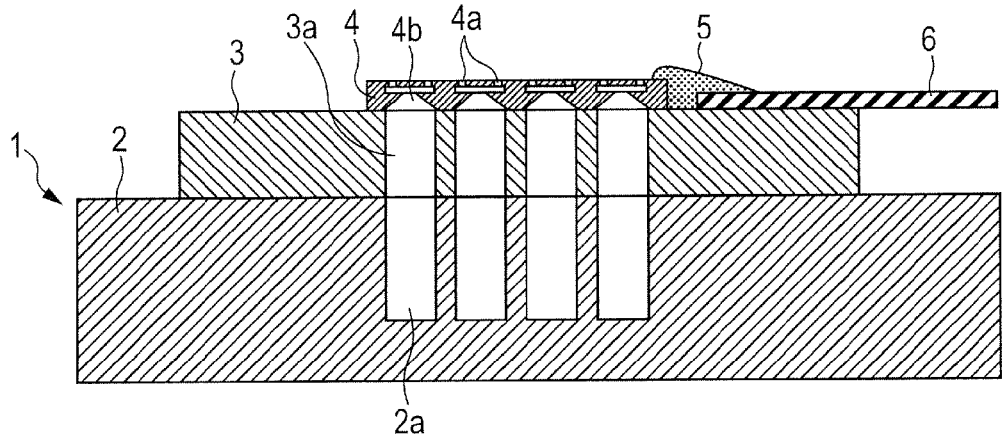
Figure 2C:
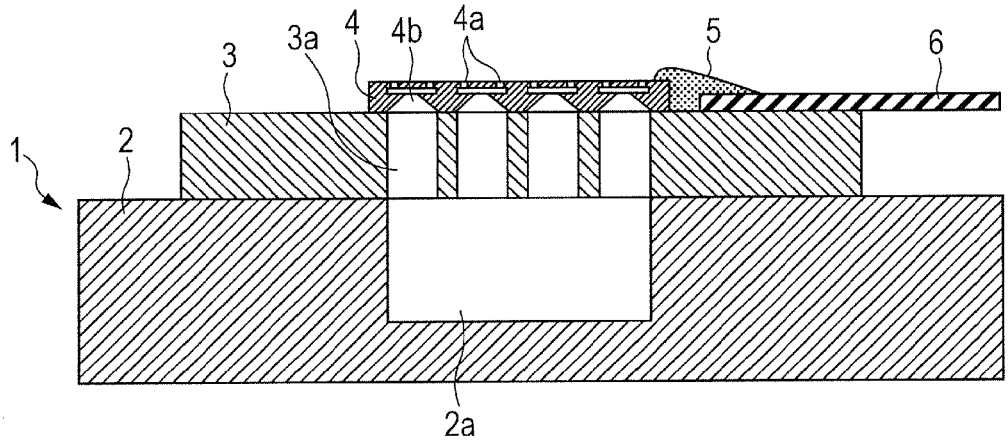

Further, as illustrated in FIG. 1A and FIGS. 2A to 2C that are cross-sectional views taken along the line 2A-2A of FIG. 1A, a plurality of ejection orifices 4*a*, from which liquid such as ink is ejected, are formed in a row in a front surface of each recording element substrate 4 (ejection orifice surface). A plurality of rows of the ejection orifices 4*a* (ejection orifice rows) are prepared. In the recording element substrate 4, a flow path communicating with each of the ejection orifices 4*a* is formed for every ejection orifice row. In each flow path, a recording element configured to generate ejection energy (for example, an electrothermal conversion element or a piezoelectric element) is arranged. Further, in a surface of the recording element substrate 4 opposite to the ejection orifice surface thereof, a plurality of liquid supply orifices 4*b* from which liquid such as ink is collectively supplied into the plurality of flow paths formed for the respective ejection orifice rows are formed. In the liquid chamber member 3, a plurality of liquid chambers 3*a* respectively communicating to the plurality of liquid supply orifices 4*b* of the recording element substrate 4 are formed. In addition, a liquid supply path 2*a* communicating with the liquid chambers 3*a* is formed in the support member 2. Regarding the liquid supply path 2*a*, as illustrated in FIGS. 2A and 2B, a plurality of liquid supply paths 2*a* may be formed to correspond to the plurality of liquid chambers 3*a*, respectively. Alternatively, as illustrated in FIG. 2C, one liquid supply path 2*a* collectively communicating to the plurality of liquid chambers 3*a* may be formed. The configuration illustrated in FIGS. 2A and 2B is effective in a case where the plurality of ejection orifice rows on the ejection orifice surface of the recording element substrate 4 are employed for respective kinds of ink (for example, dye ink or pigment ink of cyan, magenta, yellow, and black).

As illustrated in FIGS. 1A, 1B, 1C1, 1C2, and 3, the liquid chamber member 3 includes, at a center position thereof, the recording element substrate mounting portion 3*b* on which the recording element substrate 4 having a parallelogram shape in plan view is mounted. The recording element substrate mounting portion 3*b* is formed to have the outer shape (parallelogram) which is substantially the same as the outer shape of the recording element substrate 4 in plan view. Portions of the liquid chamber member 3 on both sides of the recording element substrate mounting portion 3*b* are formed as non-mounting portions 3*c* on which the recording element substrate 4 is not mounted. The non-mounting portions 3*c* are formed integrally and flush with the recording element substrate mounting portion 3*b*. Note that, the electric wiring member 6 and the sealing member 5 are arranged on the non-mounting portions 3*c*. Further, the outer shape of the recording element substrate mounting portion 3*b* according to this embodiment exhibits a parallelogram, but the present invention is not limited thereto. It is only necessary that the outer shape of the recording element substrate mounting portion 3*b* exhibit a quadrangle (for example, a trapezoid excluding an isosceles trapezoid, or a rhombus) having a pair of first sides 3*b*-1 opposing and substantially parallel to each other, and a pair of opposing second sides 3*b*-2 inclined with respect to the first sides 3*b*-1.

A region of the recording element substrate mounting portion 3*b* is formed into a parallelogram shape which is substantially the same as the outer shape of the recording element substrate 4 in plan view. Accordingly, the outer shape of an adhesion region between a back surface of the recording element substrate mounting portion 3*b* and the support member 2 exhibits substantially a parallelogram, and hence, as described above, turning of the adhesion region is liable to occur. As illustrated in Comparative Example of FIG. 1C1, when each non-mounting portion 3*c* is formed into a shape obtained by elongating and enlarging the outer shape of the recording element substrate mounting portion 3*b* along the pair of second sides 3*b*-2 (inclined sides of a parallelogram) of the recording element substrate mounting portion 3*b*, the adhesion region is also merely enlarged while keeping a parallelogram shape. As a result, occurrence of the above-mentioned turning of the adhesion region is not prevented.

Figure 3:
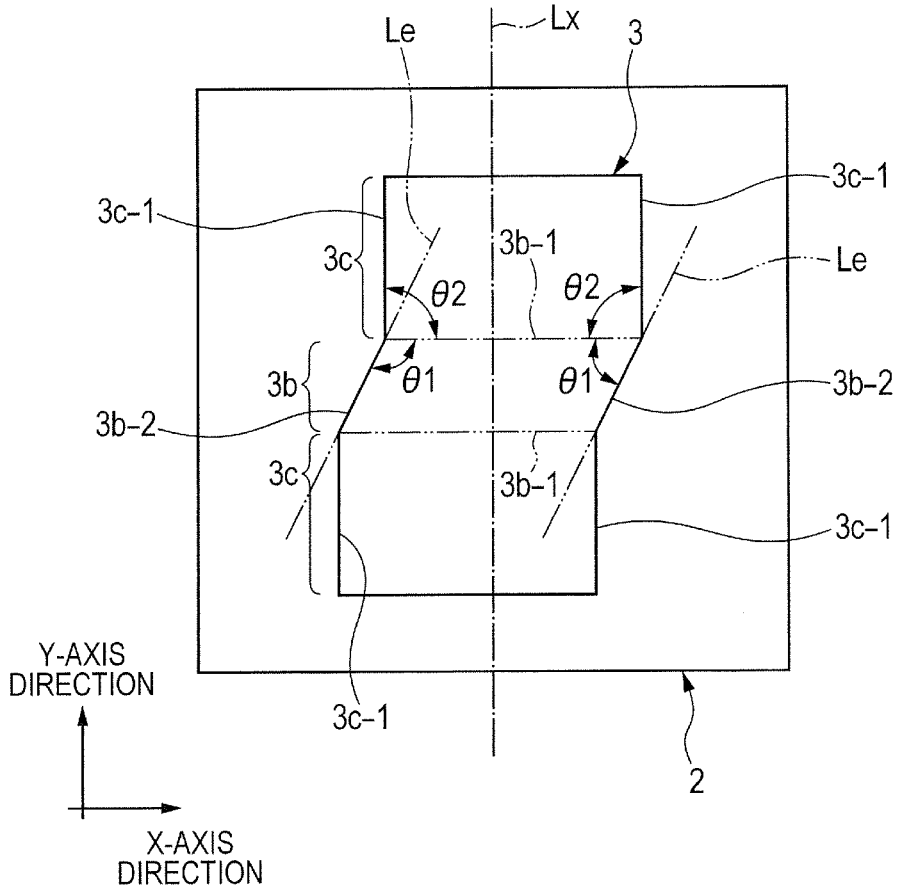
FIG. 3 is a view illustrating an outer shape of a liquid chamber member according to the first embodiment.

Accordingly, in the present invention, by devising the outer shape of the non-mounting portion 3*c* of the liquid chamber member 3, the non-mounting portion 3*c* is used as a turning preventing portion for preventing the turning of the liquid chamber member 3. As illustrated in FIGS. 1C2 and 3, the outer shape of the non-mounting portion 3*c* according to the first embodiment exhibits a shape having a pair of third sides 3*c*-1 respectively connecting with the pair of second sides 3*b*-2 of the recording element substrate mounting portion 3*b* having a parallelogram shape in plan view. The third sides 3*c*-1 each extend in a direction substantially perpendicular to the first sides 3*b*-1 of the recording element substrate mounting portion 3*b* (direction parallel to a center line Lx of FIGS. 1C1, 1C2, and 3). In other words, unlike Comparative Example, the liquid chamber member 3 does not have such a shape that the pair of third sides 3*c*-1 of the non-mounting portion 3*c* is present on respective extension lines Le of the pair of second sides 3*b*-2 of the recording element substrate mounting portion 3*b*, but the second sides 3*b*-2 and the third sides 3*c*-1 cross each other. In particular, the outer shape of the non-mounting portion 3*c* according to this embodiment exhibits substantially a rectangular shape sharing one of the first sides 3*b*-1 of the recording element substrate mounting portion 3*b* as a long side. This shape is designed in order to apply stress on the above-mentioned adhesion region as symmetrically as possible as compared to Comparative Example. Note that, the center line Lx of the recording element substrate mounting portion 3*b* passes through the center of gravity of the shape of the recording element substrate mounting portion 3*b* in a plane parallel to a surface of the recording element substrate mounting portion 3*b*, and is a line substantially perpendicular to the first sides 3*b*-1 of the recording element substrate mounting portion 3*b*.

Description is made of the embodiment illustrated in FIG. 3 from a different point of view. A surface of the liquid chamber member 3, on which the recording element substrate 4 is fixed, includes the recording element substrate mounting portion (first region) 3*b* serving as a region to which an adhesive for fixing the recording element substrate 4 is applied, and the non-mounting portion (second region) 3*c* being the remaining regions. The second regions 3*c* having a rectangular shape is arranged on both sides of the first region 3*b* having a parallelogram shape. Further, in this embodiment, one side of the recording element substrate 4 having a parallelogram shape and the electric wiring member 6 are electrically connected to each other, and the electric wiring member 6 is arranged on only one of the two second regions.

With reference to FIGS. 1C1 and 1C2, description is made of a turning preventing effect obtained depending on differences in shape of the non-mounting portion 3*c*. Note that, illustration of the recording element substrate 4 is omitted in FIGS. 1C1 and 1C2. As described above, in a case of assuming an XY orthogonal coordinate system parallel to a surface of the support member 2 configured to support the liquid chamber member 3, in the X-axis direction, the stress caused by a difference in coefficient of linear expansion between the support member 2 and the liquid chamber member 3 to act on the adhesion region between the support member 2 and the liquid chamber member 3 is represented by forces generated in opposite directions with the center line Lx of the liquid chamber member 3 (line passing through the center of gravity) therebetween. Also in the Y-axis direction, the stress is represented by forces generated in opposite directions with the center line Ly of the liquid chamber member 3 (line passing through the center of gravity) therebetween. In the X-axis direction, the forces are increased toward a peripheral edge portion of the liquid chamber member 3 distant from the center line Lx. Also in the Y-axis direction, the forces are increased toward the peripheral edge portion of the liquid chamber member 3 distant from the center line Ly. The adhesion region and the liquid chamber member 3 have the same outer shapes, and hence the center line Lx corresponds to the center line of the adhesion region. Note that, FIGS. 1C1 and 1C2 illustrate a case where the support member 2 has the coefficient of linear expansion larger than the coefficient of linear expansion of the liquid chamber member 3 (for example, the coefficient of linear expansion of the support member 2 is 30 ppm/K, and the coefficient of linear expansion of the liquid chamber member 3 is 15 ppm/K). The solid arrows of FIGS. 1C1 and 1C2 represent forces generated by thermal shrinkage of the support member 2 to act on the liquid chamber member 3, that is, forces acting on the adhesion region between the support member 2 and the liquid chamber member 3. The dotted arrows of FIGS. 1C1 and 1C2 represent, among the above-mentioned forces acting on the adhesion region, forces canceling each other out. In addition, magnitude of the forces acting on the adhesion region is represented in proportion to lengths of the solid arrows and the dotted arrows.

The above-mentioned stress acts in each of the X-axis direction and the Y-axis direction of the adhesion region, thereby generating a counterclockwise turning force caused by the stress in the X-axis direction, and a clockwise turning force caused by the stress in the Y-axis direction. At this time, when the liquid chamber member 3 has such an outer shape that the length in the Y-axis direction is larger than the length in the X-axis direction as in the case illustrated in FIGS. 1C1 and 1C2, the turning force caused by the stress in the X-axis direction is smaller than the turning force caused by the stress in the Y-axis direction. Thus, the liquid chamber member 3 is turned in a direction of clockwise turning caused by the stress in the Y-axis direction.

As is apparent from FIGS. 1C1 and 1C2, regarding the stress acting on the adhesion region between the support member 2 and the liquid chamber member 3 according to the first embodiment, the forces canceling each other out are increased, and the forces acting on the liquid chamber member 3 are reduced as compared to the case of the adhesion region between the support member 2 and the liquid chamber member 3 according to Comparative Example. In particular, as compared to Comparative Example, the liquid chamber member 3 has less portions in which the forces canceling each other out in the Y-axis direction are not present. As a result, the turning amount of the liquid chamber member 3 is reduced, and turning of the recording element module 7 is also reduced.

Figure 4A:
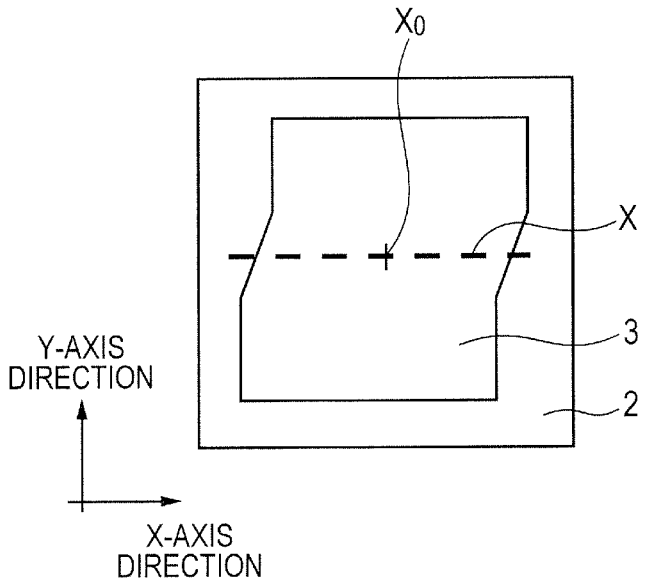
FIGS. 4A and 4B are a view and a graph illustrating turning prevention achieved in various embodiments.
Figure 4B:
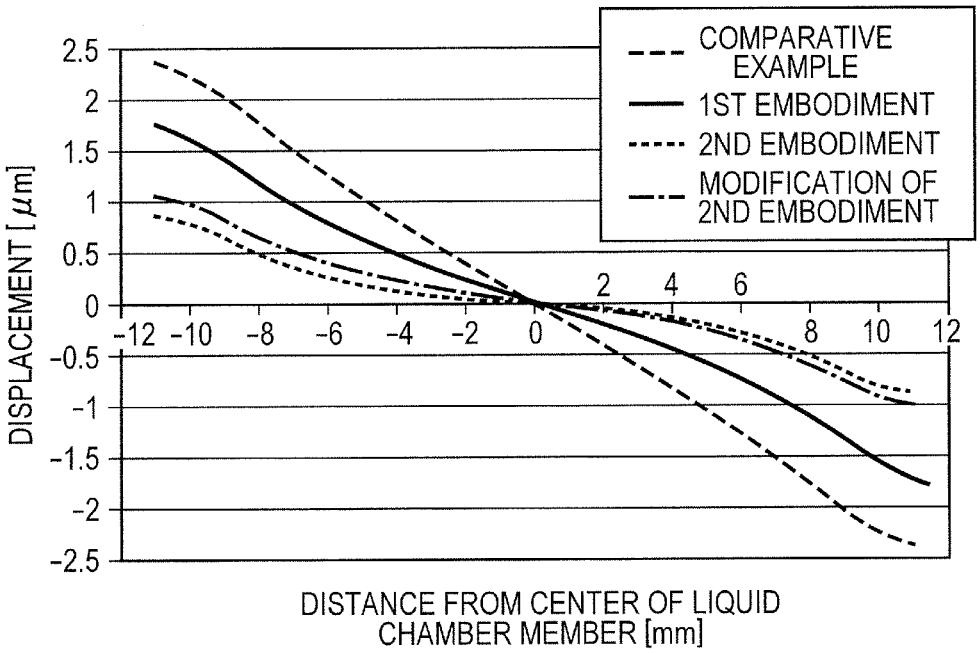

FIG. 4B shows results of simulations carried out in order to confirm whether turning is prevented or not when adopting the shape of the liquid chamber member 3 according to the first embodiment as compared to when adopting the shape according to Comparative Example. The simulations were made under the condition that the coefficient of linear expansion of the support member 2 was larger by 15 ppm/K than the coefficient of linear expansion of the liquid chamber member 3 and the temperature of the line head was lowered by 75° C. from the temperature thereof during the process of heating the line head. The above-mentioned simulations were made under the condition that the entire bottom surface of the liquid chamber member 3 was fixed to the support member 2. In this manner, turning displacement of the adhesion region between the support member 2 and the liquid chamber member 3 was confirmed.

The position of the broken line X of FIG. 4A extending along the X-axis direction is employed as a position for obtaining displacement of the liquid chamber member 3 (displacement obtaining position). The horizontal axis of a graph of FIG. 4B shows the distance from the center $X_0$ of the displacement obtaining position in the liquid chamber member 3. The distance in a rightward direction of FIG. 4A with respect to the center $X_0$ is represented by positive values, and the distance in a leftward direction opposite to the rightward direction is represented by negative values. The vertical axis of the graph of FIG. 4B shows a displacement amount in upward and downward directions with respect to the displacement obtaining position X in the liquid chamber member 3 illustrated in FIG. 4A. The displacement amount in the upward direction of FIG. 4A is represented by positive values.

As is apparent from results of Comparative Example, the liquid chamber member 3 is displaced upward in FIG. 4A in a left region of FIG. 4A with respect to the center $X_0$, whereas the liquid chamber member 3 is displaced downward in FIG. 4A in a right region of FIG. 4A with respect to the center $X_0$, respectively. This means that stress acts as indicated by the arrows of FIG. 1C1 so that the liquid chamber member 3 is turned clockwise. On the other hand, with reference to the graph of the first embodiment in FIG. 4B, the displacement amount of the liquid chamber member 3 is reduced as compared to Comparative Example. Accordingly, the effect of preventing the turning of the liquid chamber member 3 is obtained. Note that, the above-mentioned simulations were carried out under the condition that the liquid chamber member 3 was shaped so as to have the same area of the adhesion region between the support member 2 and the liquid chamber member 3 in Comparative Example and the first embodiment.

As described above, even in a case where the support member 2 and the liquid chamber member 3 have different coefficients of linear expansion, use of the liquid chamber member 3 having the outer shape illustrated (adhesion region) in FIG. 1C2 enables prevention of the turning of the liquid chamber member 3, and also turning of the recording element module 7.

Figure 1D:
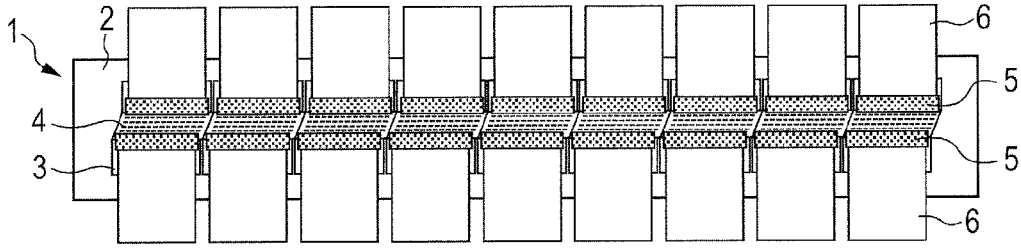

Note that, in the line head illustrated in FIGS. 1A and 1B, the electric wiring member 6 and the sealing member 5 are arranged on only one of the two non-mounting portions 3*c* positioned on the both sides of the recording element substrate mounting portion 3*b* of the liquid chamber member 3. However, as illustrated in FIG. 1D, the electric wiring member 6 and the sealing member 5 may be arranged on each of the two non-mounting portions 3*c*.

Figure 5A:
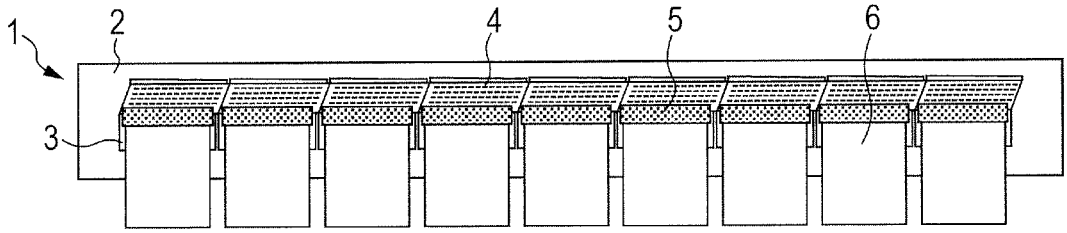
FIGS. 5A, 5B and 5C are views and a graph illustrating turning prevention achieved in a modification of the first embodiment.
Figure 5B:
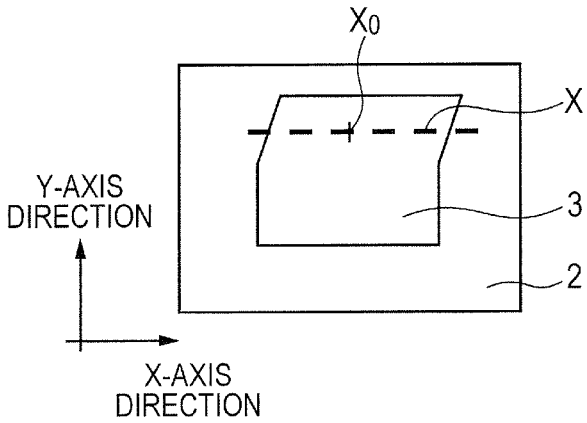

Further, above description is made regarding the liquid chamber member 3 having such a shape that the non-mounting portions 3*c* are formed on the both sides of the recording element substrate mounting portion 3*b*. However, the technical idea of the present invention is also applicable to a case where the non-mounting portion 3*c* is formed on only one side of the recording element substrate mounting portion 3*b* as illustrated in FIG. 5A. FIG. 5B illustrates a detailed shape of the liquid chamber member 3 in the above-mentioned case.

Figure 5C:
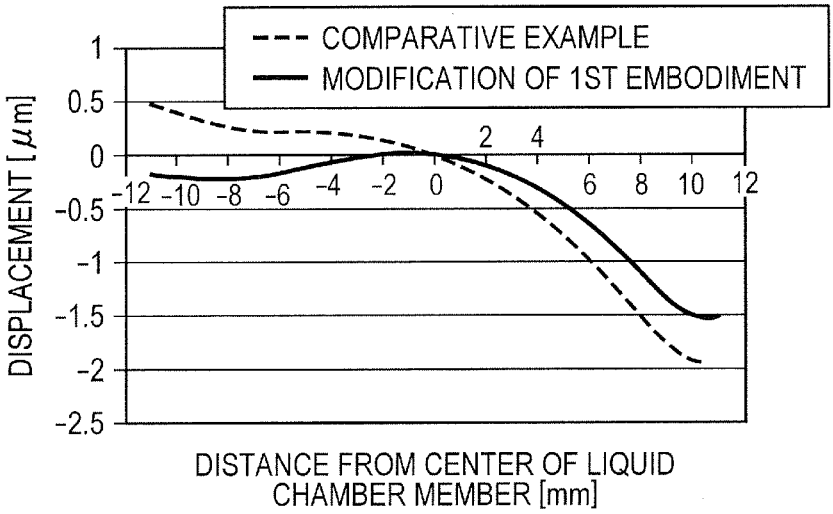

FIG. 5C shows results of simulations carried out in order to confirm whether turning is prevented or not when adopting the shape of the liquid chamber member 3 illustrated in FIG. 5B under the same condition as that of the simulations shown in FIG. 4B.

The horizontal axis of a graph of FIG. 5C shows the distance from the center $X_0$ of the displacement obtaining position of the liquid chamber member 3. The distance in a rightward direction of FIG. 5B with respect to the center $X_0$ is represented by positive values, and the distance in a leftward direction opposite to the rightward direction is represented by negative values. The vertical axis of the graph of FIG. 5C shows the displacement amount in upward and downward directions with respect to the displacement obtaining position X in the liquid chamber member 3 illustrated in FIG. 5B. The displacement amount in the upward direction of FIG. 5B is represented by positive values. As is apparent from FIG. 5C, the displacement amount is reduced in a modification of the first embodiment as compared to Comparative Example. Thus, the turning of the liquid chamber member 3 is prevented.

Further, in the first embodiment and the modification thereof, the recording element substrate 4 is mounted directly on one liquid chamber member 3, but the liquid chamber member 3 may be formed of a plurality of bonded layers. That is, the above-mentioned effect of the present invention can be obtained as long as coefficients of linear expansion of the support member 2 and the liquid chamber member 3 are different from each other in the adhesion region between the support member 2 and the liquid chamber member 3. Further, when the liquid chamber member 3 is formed of a plurality of layers, the respective layers (respective members) may be formed of the same kind or different kinds of members. For example, the liquid chamber member 3 may have a configuration obtained by laminating an alumina member and a resin member together. In this case, a side of the liquid chamber member 3 to be bonded to the recording element substrate 4 is formed of an alumina layer, and a side of the liquid chamber member 3 to be bonded to the support member 2 is formed of a resin layer. With this configuration, uniform heating of the recording element substrate 4 can be achieved, which leads to enhancement of print quality.

Second Embodiment

Figure 6A:
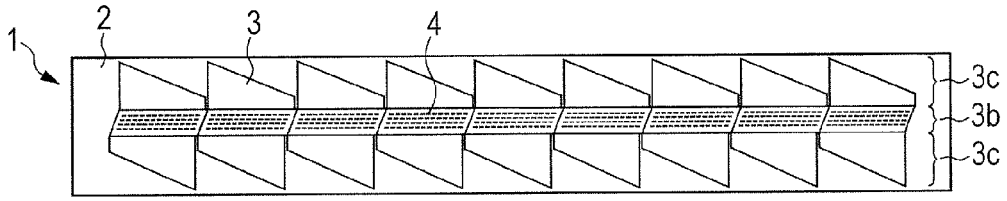
FIGS. 6A, 6B, 6C and 6D are views illustrating a second embodiment of the present invention.
Figure 6B:
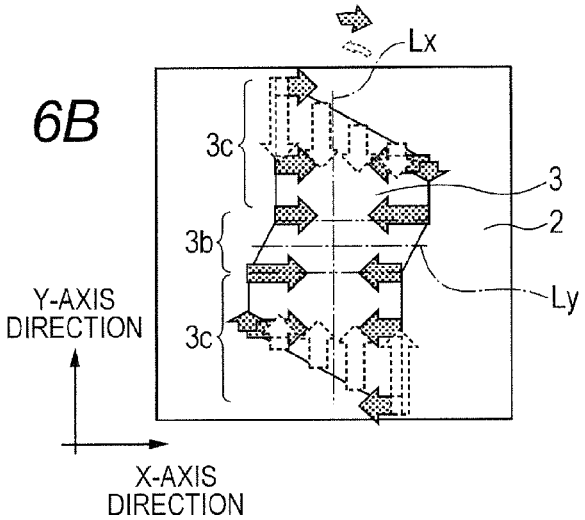

Next, a second embodiment of the present invention is described with reference to FIGS. 6A to 6D. The second embodiment is configured so as to further prevent the turning of the liquid chamber member 3 as compared to the first embodiment. Note that, in order to help understanding of this embodiment, illustration of the electric wiring member 6 and the sealing member 5 is omitted in each of FIGS. 6A to 6D, and illustration of the recording element substrate 4 is also omitted in FIGS. 6B and 6D. FIG. 6A is a schematic view illustrating a liquid ejection head according to the second embodiment. FIG. 6B is a view illustrating a turning preventing effect obtained in the second embodiment. FIG. 7A is a view illustrating an outer shape of the liquid chamber member 3 according to the second embodiment.

As illustrated in FIG. 7A, the outer shape of the non-mounting portion 3*c* of the liquid chamber member 3 according to the second embodiment is similar to that of the first embodiment in that the non-mounting portion 3*c* has the pair of third sides 3*c*-1 respectively connecting with the pair of second sides 3*b*-2 of the recording element substrate mounting portion 3*b*, and that the third sides 3*c*-1 extend in a direction perpendicular to the first sides 3*b*-1 of the recording element substrate mounting portion 3*b* (direction parallel to the center line Lx in FIG. 7A). However, the pair of third sides 3*c*-1 has the same length in the first embodiment, whereas in the second embodiment, one of the third sides 3*c*-1 (left side in FIG. 7A), which is closer to the center line Lx when comparing distances d1, d2 respectively from the pair of third sides 3*c*-1 to the center line Lx, has a length larger than the length of the other one of the third sides 3*c*-1 (right side in FIG. 7A) more distant from the center line Lx. In particular, the outer shape of the non-mounting portion 3*c* according to the second embodiment exhibits a trapezoid shape having the respective third sides 3*c*-1 with different lengths and having the first side 3*b*-1 of the recording element substrate mounting portion 3*b* as a leg.

In other words, from the one of the third sides 3*c*-1 of the non-mounting portion 3*c* closer to the center line Lx of the recording element substrate mounting portion 3*b* toward the other one of the third sides 3*c*-1 more distant from the center line Lx of the recording element substrate mounting portion 3*b*, the length between the two legs of the trapezoid in the direction parallel to the center line Lx decreases.

Description is further made from a different point of view. A surface of the liquid chamber member 3, on which the recording element substrate 4 is fixed, includes the recording element substrate mounting portion (first region) 3*b* serving as a region to which an adhesive for fixing the recording element substrate 4 is applied, and the non-mounting portion (second region) 3*c* being the remaining region. The second region 3*c* having a trapezoid shape is provided on the both sides of the first region 3*b* having a parallelogram shape.

The non-mounting portion 3*c* is shaped so as to have the above-mentioned outer shape. In this manner, as illustrated in FIG. 6B, the liquid chamber member 3 has less portions where the forces canceling each other out in the Y-axis direction are not present, as compared to Comparative Example, thereby further preventing the turning of the liquid chamber member 3. In particular, in this embodiment, from the one of the third sides 3*c*-1 of the non-mounting portion 3*c* closer to the center line Lx of the recording element substrate mounting portion 3*b* toward the other one of the third sides 3*c*-1 more distant from the center line Lx of the recording element substrate mounting portion 3*b*, the length between the two legs of the trapezoid in the direction parallel to the center line Lx is decreased, thereby increasing a turning force in a direction reverse to the clockwise turning illustrated in FIG. 1C2. As a result, as compared to the first embodiment, the forces which act on the portions where forces canceling each other out in the Y-axis direction are not present are decreased, and then the clockwise turning of the liquid chamber member 3 caused by the forces in the Y-axis direction is reduced. This phenomenon is understood through comparison between the solid arrows of FIGS. 1C2 and 6B.

The result of the simulation actually carried out is shown by the dotted line indicating the second embodiment in the graph of FIG. 4B. As is apparent from the graph, the turning of the liquid chamber member 3 is further prevented as compared to the first embodiment. Note that, the outer shape of the liquid chamber member 3 subjected to the simulation is set so as to have the same area of the adhesion region between the support member 2 and the liquid chamber member 3 as those of Comparative Example and the first embodiment.

Figure 6C:
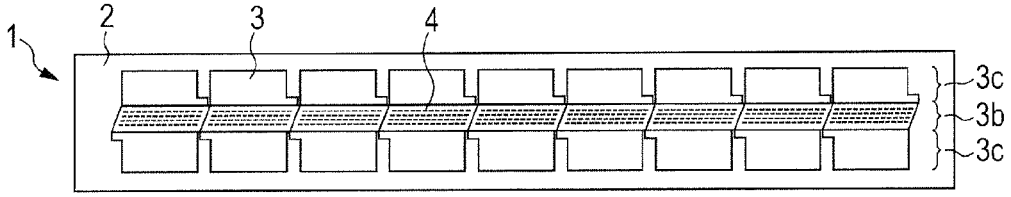
Figure 6D:
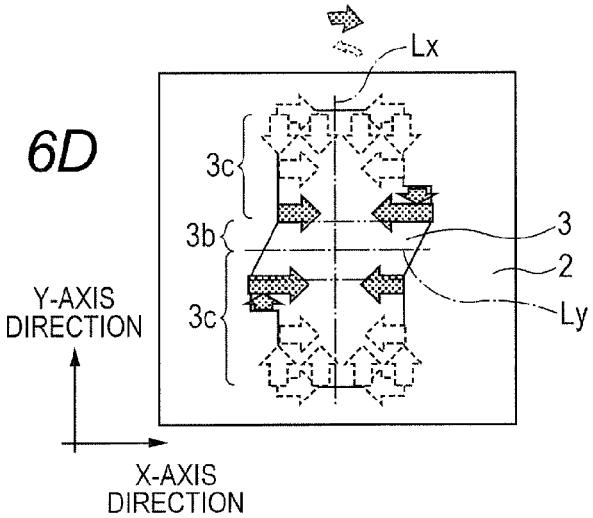
Figure 7A:
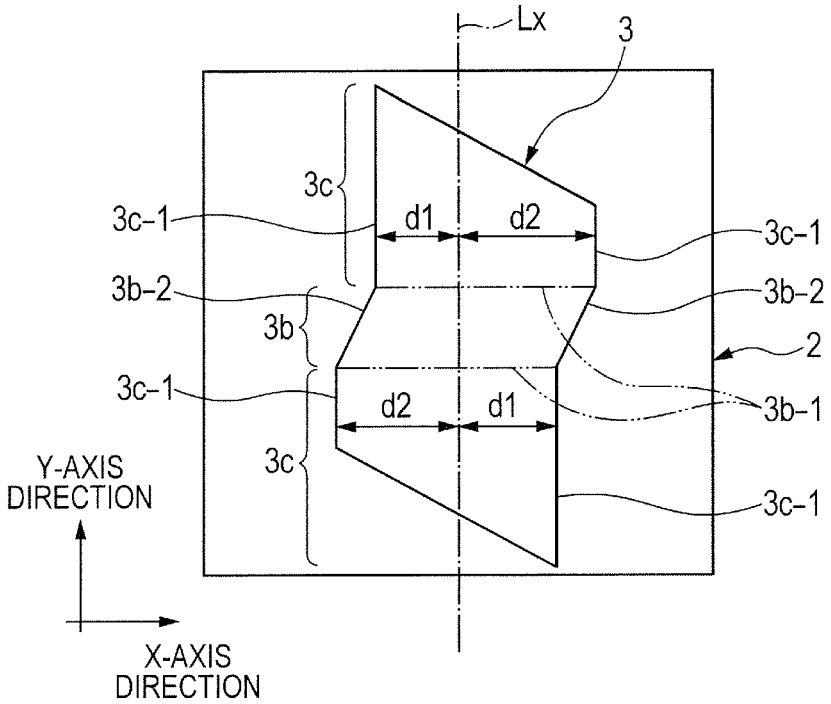
FIGS. 7A and 7B are views illustrating an outer shape of the liquid chamber member according to the second embodiment and a modification of the second embodiment.
Figure 7B:
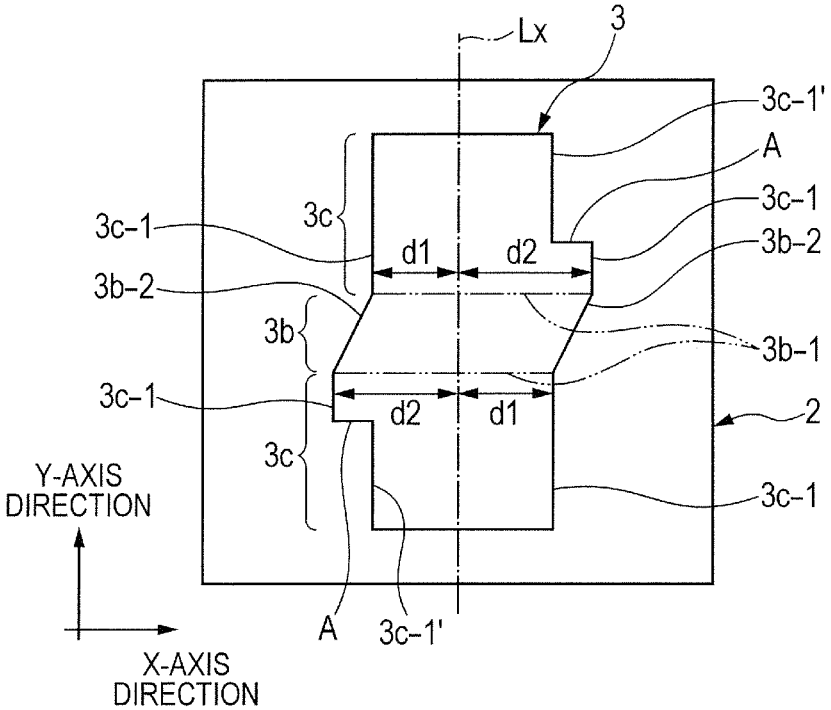

Further, FIGS. 6C, 6D, and 7B illustrate an outer shape of the liquid chamber member 3 according to a modification of the second embodiment. In the non-mounting portion 3*c* having the outer shape illustrated in FIGS. 6A and 7A, dimensions of a region for mounting the electric wiring member 6 vary in lengthwise and widthwise directions. The modification of the second embodiment is suitable for a case where the variations of the dimensions of the region for mounting the electric wiring member 6 need to be reduced as much as possible while attaining the above-mentioned turning preventing effect.

As illustrated in FIG. 7B, the outer shape of the non-mounting portion 3*c* of the liquid chamber member 3 according to the modification of the second embodiment is similar to that of the first embodiment in that the non-mounting portion 3*c* has the pair of third sides 3*c*-1 respectively connects with the second sides 3*b*-2 of the recording element substrate mounting portion 3*b*, and that the third sides 3*c*-1 have a shape extending in a direction perpendicular to the first sides 3*b*-1 of the recording element substrate mounting portion 3*b* (direction parallel to the center line Lx of FIG. 7B). However, in the modification of the second embodiment, one of the third sides 3*c*-1 (left side in FIG. 7B), which is closer to the center line Lx when comparing distances d1, d2 respectively from the pair of third sides 3*c*-1 to the center line Lx, is formed of only a straight side parallel to the center line Lx. On the other hand, the other one of the third sides 3*c*-1 (right side in FIG. 7B) more distant from the center line Lx includes a step "A" formed at an intermediate portion thereof and connects to a straight side 3*c*-1' that is parallel to the other one of the third sides 3*c*-1 and is closer to the center line Lx.

The non-mounting portion 3*c* is shaped so as to have the above-mentioned outer shape of FIG. 7B. In this manner, as illustrated in FIG. 6D, the liquid chamber member 3 has less portions where the forces canceling each other out in the Y-axis direction are not present, as compared to Comparative Example, thereby further preventing the turning of the liquid chamber member 3. In particular, in the modification of the second embodiment, as illustrated in FIG. 7B, the non-mounting portion 3*c* is formed into a shape obtained by cutting out a portion in the vicinity of the extension of the another one of the third sides 3*c*-1 (right side in FIG. 7B) more distant from the center line Lx, thereby reducing the clockwise turning force illustrated in FIG. 1C2. As a result, as compared to the first embodiment, the forces which act on the portions where forces canceling each other out in the Y-axis direction are not present are decreased, and thus the clockwise turning of the liquid chamber member 3 caused by the forces in the Y-axis direction is reduced. This phenomenon is understood through comparison between the solid arrows of FIGS. 1C2 and 6D. In addition, the sum of the length of the other one of the third sides 3*c*-1 more distant from the center line Lx and the length of the side 3*c*-1' connecting with the other one of the third sides 3*c*-1 via the step "A" is set to be equal to a length of the one of the third sides 3*c*-1 close to the center line Lx. Accordingly, as compared to the mode illustrated in FIG. 7A, it is possible to reduce the variations in directions of the dimensions of the region for mounting the electric wiring member 6.

FIG. 4B shows the result of the simulation according to the modification of the second embodiment. As is apparent from the graph showing the result of the modification of the second embodiment, as compared to the second embodiment, the amount of the turning of the liquid chamber member 3 is slightly increased, but the turning of the liquid chamber member 3 is prevented as compared to the first embodiment. Most of all, according to the modification of the second embodiment, as compared to the second embodiment, the turning of the liquid chamber member 3 can be prevented to a larger extent than in the first embodiment without imbalance of the dimension of the region for mounting the electric wiring member 6. Note that, the outer shape of the liquid chamber member 3 subjected to the simulation is set so as to have the same area of the adhesion region between the support member 2 and the liquid chamber member 3 as those of Comparative Example, the first embodiment, and the second embodiment.

The liquid ejection head 1 described above has a configuration in which the recording element substrate 4 is mounted on the support member 2 via the liquid chamber member 3, but in the present invention, it is not necessary to form the liquid chamber member 3 and the recording element substrate 4 completely separately. Recording elements or ink ejection orifices may be formed on an upper surface of the liquid chamber member 3. In short, as long as the outer shape of a member to be fixed on the support member 2 by bonding exhibits the outer shape according to each of the above-mentioned embodiments, the structure of the member can be arbitrarily modified as appropriate.

Further, the outer shape of the recording element substrate 4 according to the above-mentioned embodiments exhibits a parallelogram, but it is only necessary that the outer shape of the recording element substrate applied to the present invention have an arbitrary side and at least two opposing inclined sides each inclined with respect to the arbitrary side. For example, the outer shape of the recording element substrate 4 may exhibit a trapezoid excluding an isosceles trapezoid or a rhombus. In addition, it is desired that the outer shape of the recording element substrate mounting portion 3*b* be formed so that the two inclined sides of the recording element substrate and the pair of inclined second sides 3*b*-2 of the recording element substrate mounting portion 3*b* substantially conform to each other when the recording element substrate 4 having the above-mentioned outer shape is mounted on the recording element substrate mounting portion 3*b* of the liquid chamber member 3. It is desired that, when the plurality of recording element modules 7 are arrayed on the support member 2 having a long length, the inclined sides of the respective recording element substrates 4 be arranged close to or in intimate contact with each other along the arraying direction.

Further, in each of the above-mentioned embodiments, the pair of third sides 3*c*-1 of the non-mounting portion 3*c* is orthogonal to the first sides 3*b*-1 of the recording element substrate mounting portion 3*b*. As long as a higher effect of preventing the turning of the liquid chamber member 3 is obtained than in Comparative Example, the present invention is not limited to the outer shape of the non-mounting portion 3*c* having the pair of third sides 3*c*-1 as described above. That is, in the present invention, as illustrated in FIG. 3, as long as a third angle that is the sum of a first angle θ1 formed by one of the first sides 3*b*-1 and one of the second sides 3*b*-2 and a second angle θ2 formed by the one of the first sides 3*b*-1 and one of the third sides 3*c*-1 is larger than 180 degrees (θ1+θ2 on the left side of FIG. 3) with respect to one of the second sides 3*b*-2 of which the first angle θ1 is larger than 90 degrees, and the third angle is smaller than 180 degrees (θ1+θ2 on the right side of FIG. 3) at another one of the second sides 3*b*-2 at which the first angle θ1 is smaller than 90 degrees, the higher effect of preventing the turning of the liquid chamber member 3 can be obtained than in Comparative Example. The plan view shape of the non-mounting portion 3*c* encompasses any polygon shape as long as this condition of angles is satisfied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099417, filed May 13, 2014 and Japanese Patent Application No. 2015-032690, filed Feb. 23, 2015 which are hereby incorporated by reference herein in their entirety.

What is claimed is:

1. A liquid ejection head, comprising:

a support member;

a liquid chamber member being mounted on the support member through an adhesive and comprising a liquid chamber formed therein; and a recording element substrate being mounted on the liquid chamber member and comprising an ejection orifice from which liquid is ejected and a recording element configured to generate ejection energy, wherein the support member has a coefficient of linear expansion different from a coefficient of linear expansion of the liquid chamber member, wherein the liquid chamber member comprises:

a recording element substrate mounting portion on which the recording element substrate is mounted; and a non-mounting portion on which no recording element substrate is mounted, the non-mounting portion being formed integrally with the recording element substrate mounting portion, wherein a plan view shape of the recording element substrate mounting portion has a pair of opposing and parallel first sides and a pair of opposing second sides not perpendicular to the pair of first sides, wherein a plan view shape of the non-mounting portion exhibits a polygonal shape sharing one of the pair of the first sides and has a pair of third sides respectively connecting with the pair of second sides, wherein, in a case where a first angle formed by one of the pair of first sides and one of the pair of second sides is larger than 90 degrees, a third angle that is the sum of the first angle and a second angle formed by the one of the pair of first sides and one of the pair of third sides is larger than 180 degrees, and wherein, in a case where the first angle is smaller than 90 degrees, the third angle is smaller than 180 degrees.

2. A liquid ejection head according to claim 1, wherein the liquid chamber member comprises a plurality of liquid chamber members, and the recording element substrate comprises a plurality of recording element substrates, and wherein the plurality of liquid chamber members are arranged on the support member having a long length, and the plurality of recording element substrates are respectively mounted on the plurality of liquid chamber members.

3. A liquid ejection head according to claim 2, wherein the plurality of liquid chamber members mounted on the support member are arrayed in line, and second sides of a pair of the liquid chamber members adjacent to each other are close to each other.

4. A liquid ejection head according to claim 1, wherein the plan view shape of the recording element substrate mounting portion is substantially the same as a plan view shape of the recording element substrate.

5. A liquid ejection head according to claim 1, wherein, when defining a line being orthogonal to the pair of first sides and passing through a center of gravity of the recording element substrate mounting portion as a center line, and comparing one of the pair of third sides closer to the center line and the other one of the pair of third sides more distant from the center line, the other one of the pair of third sides is shorter than the one of the pair of third sides.

6. A liquid ejection head according to claim 1, wherein a plan view shape of the recording element substrate and the plan view shape of the recording element substrate mounting portion each exhibit a parallelogram.

7. A liquid ejection head according to claim 1, wherein on the support member, a plurality of recording element modules are arranged, the plurality of recording element modules each comprising the liquid chamber member, the recording element substrate, and an electric wiring member electrically connected to the recording element substrate.

8. A liquid ejection head according to claim 7, wherein the plurality of recording element modules are arranged in line on the support member.

9. A liquid ejection head according to claim 7, wherein the electric wiring member is electrically connected to one side of the recording element substrate.

10. A recording apparatus, comprising the liquid ejection head of claim 1, wherein the recording apparatus is configured to perform recording by ejecting liquid onto a recording medium from the ejection orifice of the liquid ejection head.

11. A liquid ejection head, comprising:

a support member;

a liquid chamber member being fixed onto the support member through an adhesive and comprising a liquid chamber configured to store liquid therein; and a recording element substrate being fixed onto the liquid chamber member through the adhesive and comprising an ejection orifice from which the liquid is ejected and a recording element configured to generate ejection energy, wherein the support member and the liquid chamber member have different coefficients of linear expansion, wherein a surface of the liquid chamber member on the recording element substrate side comprises:

a first region on which the adhesive for fixing the recording element substrate is applied; and a second region being a region other than the first region, and wherein the first region has a parallelogram shape, and the second region has a rectangular shape.

12. A liquid ejection head according to claim 11, wherein a plan view shape of the recording element substrate exhibit a parallelogram.

13. A liquid ejection head according to claim 11, wherein on the support member, a plurality of recording element modules are arranged, the plurality of recording element modules each comprising the liquid chamber member, the recording element substrate, and an electric wiring member electrically connected to the recording element substrate.

14. A liquid ejection head according to claim 13, wherein the plurality of recording element modules are arranged in line on the support member.

15. A liquid ejection head according to claim 13, wherein the electric wiring member is arranged on the second region.

16. A liquid ejection head according to claim 11, wherein the second region comprises a plurality of second regions and is formed on both sides of the first region.

17. A liquid ejection head according to claim 16, wherein the electric wiring member is arranged on one of the plurality of second regions.

18. A liquid ejection head, comprising:

a support member;

a liquid chamber member being fixed onto the support member via an adhesive and comprising a liquid chamber configured to store liquid therein; and a recording element substrate being fixed onto the liquid chamber member via the adhesive and comprising an ejection orifice from which the liquid is ejected and a recording element configured to generate ejection energy, wherein the support member and the liquid chamber member have different coefficients of linear expansion, wherein a surface of the liquid chamber member on the recording element substrate side comprises:

a first region on which the adhesive for fixing the recording element substrate is applied; and a second region being a region other than the first region, and wherein the first region has a parallelogram shape, and the second region has a rectangular shape.

19. A liquid ejection head according to claim 18, wherein a plan view shape of the recording element substrate exhibit a parallelogram.

20. A liquid ejection head according to claim 18, wherein on the support member, a plurality of recording element modules are arranged, the plurality of recording element modules each comprising the liquid chamber member, the recording element substrate, and an electric wiring member electrically connected to the recording element substrate.

* * * * *